US005716231A

United States Patent [19]

Meeker et al.

[11] Patent Number: 5,716,231

[45] Date of Patent: Feb. 10, 1998

[54] SENSOR BREAKOUT LEAD

[75] Inventors: Michael B. Meeker; Gary S. Wollert, both of Kenosha, Wis.

[73] Assignee: Snap-on Technologies, Inc., Lincolnshire, Ill.

[21] Appl. No.: 705,544

[22] Filed: Aug. 29, 1996

[51] Int. Cl.[6] ..... H01R 11/00

[52] U.S. Cl. ..... 439/502; 324/543; 174/71 R; 439/912

[58] Field of Search ..... 439/502, 623, 439/624, 912; 324/543; 174/71 R, 72 R, 114 S

[56] References Cited

U.S. PATENT DOCUMENTS

| | | | |
|---|---|---|---|
| 1,223,750 | 4/1917 | Wakefield | 174/59 |
| 1,336,205 | 4/1920 | Davis | 174/138 F |
| 1,705,159 | 3/1929 | Rouse | 174/74 A |
| 2,144,872 | 1/1939 | Cruser | 174/95 |
| 2,943,140 | 6/1960 | Bender | 174/93 |
| 2,946,839 | 7/1960 | Horning | 174/93 |
| 3,007,995 | 11/1961 | Schneiderman | 174/93 |
| 3,009,986 | 11/1961 | Stephens | 174/84 C |
| 3,040,121 | 6/1962 | Gillemot | 174/93 |
| 3,113,997 | 12/1963 | Schneiderman | 174/138 F |
| 3,194,878 | 7/1965 | Schneiderman | 174/138 F |
| 3,209,061 | 9/1965 | Mier et al. | 174/5 R |
| 4,466,581 | 8/1984 | Hill | 242/388.1 |
| 4,846,697 | 7/1989 | Rodgers | 439/623 |
| 4,985,598 | 1/1991 | Bubica et al. | 174/93 |
| 5,351,002 | 9/1994 | Wollert et al. | 324/754 |
| 5,456,959 | 10/1995 | Dawes | 174/74 R |

OTHER PUBLICATIONS

Catalog p. 107 showing breakout boxes.
MPSI flyer for IBOB 9000 breakout box.

*Primary Examiner*—Neil Abrams
*Assistant Examiner*—T. C. Patel
*Attorney, Agent, or Firm*—Emrich & Dithmar

[57] ABSTRACT

A breakout lead includes a length of insulated conductor having a bare uninsulated portion, and an insulating tubular sleeve coaxially and frictionally fitted around said insulated conductor and slidably movable therealong for covering and uncovering the bare insulated portion. Male and female terminals are respectively connected to the ends of the conductor length and are preferably covered by insulating boots.

12 Claims, 1 Drawing Sheet

SENSOR BREAKOUT LEAD

BACKGROUND OF THE INVENTION

1. Field of the Invention

The present invention relates to electrical conductors or leads and, in particular, to conductors which are designed to be temporarily connected between electrical terminals, such as for test purposes or the like.

1. Description of the Prior Art

There are various types of electrical leads or connectors which have been used for temporarily connecting two terminals for test purposes or the like. One common device is a jumper lead or cable which is simply a length of insulated conductor with the ends thereof respectively connected to connector terminals, typically in the form of alligator-clip terminals. Such jumper leads are usable in a variety of different applications, but the alligator clip connectors cannot be used in certain applications, such as connection to a female socket-type terminal, or for connection to only one of a number of closely-spaced terminals. Furthermore, the use of such jumper leads requires ready access to a terminal. Thus, for example, it is not usable for connection to one terminal of a multi-terminal plug-and-socket connection without disconnecting the plug from the socket.

It is also known to provide test probe leads which can be inserted between the seals and the conductors of terminal connectors to contact the conductor without disconnecting the connector. Such a test probe is disclosed, for example, in U.S. Pat. No. 5,351,002. But such probes can slip off the connector and have only limited application. Also, the test probe affords only a single-point connection. Furthermore, neither jumper leads nor test probes provide firm, reliable electrical contact.

Another type of prior art test connection device is a breakout box, which is designed for selectively testing terminals of a multi-terminal connection. The breakout box has two multi-conductor cables, respectively terminated by male and female multi-terminal connectors, which are respectively adapted to mate with connectors of associated devices. The breakout box is provided with a connection point for each of the multiple conductors so that individual conductors can be selectively probed or tested without affecting the continuity of that conductor or other conductors of the connection. However, such breakout boxes are necessarily specifically designed for a particular application, and the cable connectors of the box must be designed to mate with a specific type of connector on the associated equipment. Thus, different breakout boxes would have to be provided for testing equipment with other types of connectors. Also, the breakout box is fairly complex and expensive.

SUMMARY OF THE INVENTION

It is a general object of the invention to provide an improved test lead which avoids the disadvantages of prior leads while affording additional structural and operating advantages.

An important feature of the invention is the provision of a breakout lead which is extremely versatile and can be used in a wide variety of applications.

A further feature of the invention is the provision of a breakout lead of the type set forth which can be easily substituted in an electrical connection for testing the connection without impairing the continuity thereof.

A still further feature of the invention is the provision of a breakout lead of the type set forth which provides a firm, reliable connection to the associated device.

Still another feature of the invention is the provision of a breakout lead of the type set forth, which is of simple and economical construction.

Certain features of the invention are attained by providing a breakout lead comprising: a length of continuous uniform electrical conductor having opposed ends, an electrically insulating sheath covering the conductor along substantially the entire length except for a bare uninsulated portion intermediate the ends, an electrically insulating cover carried by the sheath and movable between first and second positions respectively covering and exposing the bare uninsulated portion, and electrical terminals respectively connected to the ends of the conductor.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
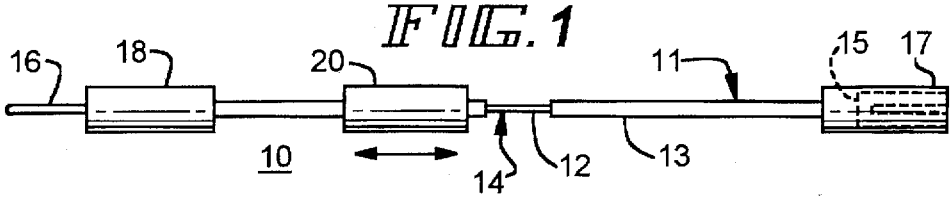
FIG. 1 is a side elevational view of a breakout lead in accordance with a first embodiment of the present invention.

Referring to FIG. 1, there is illustrated a breakout lead generally designated by the numeral 10, constructed in accordance with the present invention. The breakout lead 10 comprises a length 11 of insulated conductor which includes a length of continuous, uniform electrical conductor 12 covered by an electrically insulating sheath 13 along the entire length 11, except for a bare, uninsulated portion 14, which may be formed by simply removing a portion of the insulating sheath 13 from the length 11. The conductor 12 is connected at one end of the length 11 to a female terminal 15 and at the other end to a male terminal 16, the connections preferably being encased in insulating boots 17 and 18, respectively.

A tubular cover 20, formed of a suitable electrically insulating material, is telescopically fitted over the length 11 of insulated conductor with a friction fit, the cover 20 having a length greater than the length of the bare, uninsulated portion 14 of electrical conductor preferably, the frictional engagement between the cover 20 and the insulating sheath 13 is such as to accommodate manual sliding movement of the cover 20 longitudinally in the directions indicated by the arrow in FIG. 1 along the length 11, and high enough to prevent inadvertent or accidental movement of the cover 20. It will be appreciated that, the cover 20 is movable between a first position covering the bare uninsulated portion 14 (see FIG. 3) and a second position exposing the bare uninsulated portion 14, illustrated in FIG. 1. It will further be appreciated that, in the position illustrated in FIG. 1, the bare uninsulated portion 14 is accessible for electrical connection to associated devices.

The electrical conductor 12 may be any of a number of known types of conductors, such as a single solid wire, twisted plural wire strands, or the like, formed of any suitable electrically conducting material, such as copper, aluminum or the like. Preferably, the length 11 is cut from a supply of a suitable commercially available insulated conductor.

Figure 2:
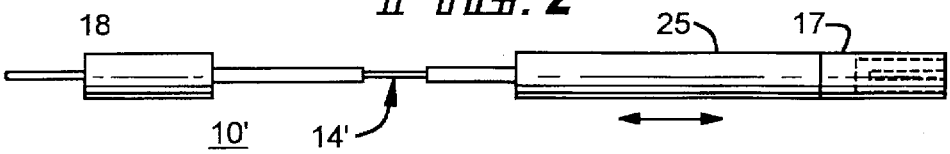
FIG. 2 is a view similar to FIG. 1 of another embodiment of breakout lead in accordance with the present invention.

In the breakout lead 10, the bare uninsulated portion 14 is disposed centrally of the length 11, and the cover 20 has a length great enough to cover the bare uninsulated portion 14, but substantially less than half the length 11. In FIG. 2 there is illustrated an alternative form of the breakout lead, generally designated by the numeral 10', which is substantially identical to the breakout lead 10, except that it has a bare uninsulated portion 14', which is located off center, and an insulating cover 25, which has a length substantially half the distance between the insulating boots 17 and 18. Thus, it will be appreciated that when the cover 25 is pushed all the way to the right, against the insulating boot 17, as illustrated in FIG. 2, it will expose the bare insulated portion 14', and when it is pushed all the way to the left against the insulating boot 18, it will cover the bare uninsulated portion 14'. Thus, positive stops are provided for the insulating cover 25 in its first and second positions.

Figure 3:
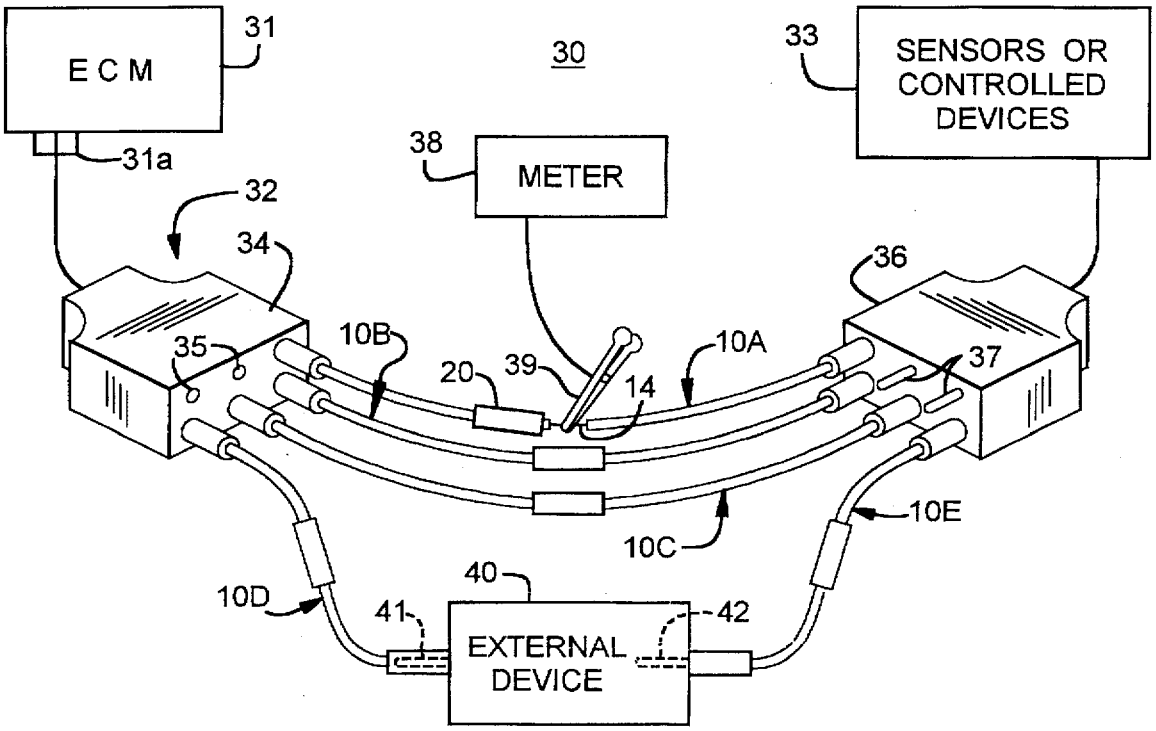
FIG. 3 is a diagrammatic view of a system illustrating application of the breakout lead of FIG. 1.

Referring now to FIG. 3, there is illustrated a system 30 in which the breakout lead 10 of the present invention can be utilized. The system 30 includes an electronic control module 31, which is in the nature of an on-board computer of the type typically utilized on automotive vehicles for monitoring certain engine and other vehicle parameters and for controlling certain engine operations. The module 31 is typically provided with a suitable electrical connector 31*a*, which is connected to a wiring harness 32 which couples the module 31 to one or more sensors or controlled devices 33 on the vehicle. The wiring harness includes a plug-and-socket combination, including a socket 34 having a plurality of female terminals 35 and a plug 36 having a plurality of male terminals or pins 37, the plug 36 being adapted to mateably engage with the socket 34, with the pins 37 being respectively received in corresponding ones of the female terminals 35, in a known manner.

It is frequently desirable to test individual ones of the conductor paths effected by the pin connections of the plug and socket combination 34, 36. In the past, this would have required the insertion between the plug 36 and the socket 34 of a breakout box, which would have to have been specifically designed for this particular application, a relatively expensive proposition. Furthermore, breakout boxes are typically designed for use with connections having a large number of pins, typically in excess of 30, and breakout boxes are not readily available for connectors having relatively few pins, such as the six-pin connectors of FIG. 3.

By the use of the present invention individual pin connections of the multi-pin connectors 34, 36 can readily be accessed. For purposes of illustration, three of the pins 37 of the plug 36 have been shown directly connected to their corresponding female terminals 35 by breakout leads of the present invention, respectively designated 10A, 10B and 10C. Any one of these connections can be tested, as with a meter 38 and an associated alligator clip connector 39, by simply moving the cover 20 to expose the bare uninsulated portion 14 of the electrical conductor, without disturbing the connection between the other two pins. To prevent inadvertent contact with the conductor of the breakout leads 10B and 10C, their covers 20 are left in the closed or covering position.

An important advantage of the present invention is that it will permit a user to examine the effect of disconnecting only selected ones of the pin connections. Thus, in the application illustrated in FIG. 3, two of the pins 37 have been left unconnected to their associated female terminals 35. The present invention will also readily permit connection of an external device in series with one or more of the pin connections. Thus, for example, there is illustrated an external device 40 which is provided with a male connector 41 and a female connector 42. The device 40 could be of any of a number of different types, e.g., an impedance, a current meter, a signal source, or the like. A breakout lead 10D is used to connect the male connector 41 to the desired one of the female terminals 35 of the socket 34, while another breakout lead 10E is used to connect the female connector 42 to the corresponding pin 37 of the plug 36. Other applications for the breakout lead of the present invention will readily be appreciated by those skilled in the art.

From the foregoing, it can be seen that there has been provided an improved breakout lead which is of simple and economical construction, and which can be easily substituted for an individual conductor of a multi-conductor electrical connection in a wide variety of applications, for facilitating testing of selected connections while at the same time providing firm reliable connections to associated devices.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A breakout lead comprising:

a length of continuous, uniform, electrical conductor having opposed ends;

an electrically insulating sheath covering only said conductor along substantially the entire length except for a bare, uninsulated portion intermediate the ends;

a single electrically insulating cover carried by said sheath and movable between first and second positions, respectively covering and exposing said bare uninsulated portion, said cover being so dimensioned that in its first position it spans said bare uninsulated portion and engages said sheath at both ends of said bare uninsulated portion; and electrical terminals respectively connected to said ends of said conductor.

2. The breakout lead of claim 1, wherein said bare, uninsulated portion is disposed substantially centrally of the length.

3. The breakout lead of claim 1, wherein said electrical terminals are, respectively, male and female terminals.

4. The breakout lead of claim 3, and further comprising electrically insulating boots, respectively covering said electrical terminals so that no portion of said female terminal extends beyond the associated boot.

5. The breakout lead of claim 1, wherein said cover includes a tubular sleeve having a single inner diameter along its entire length coaxially encircling said sheath and slidably movable longitudinally therealong between said first and second positions.

6. The breakout lead of claim 5, wherein said sleeve is frictionally fitted on said sheath so as to inhibit unintentional sliding movement thereon.

7. The breakout lead of claim 5, wherein said bare, uninsulated portion is disposed closer to one of said ends than to the other, said sleeve having a length such that it abuts one of said electrical terminals in said first position and abuts the other of said electrical terminals in said second position.

8. In combination:

a socket having a plurality of female terminals;

a plug having a plurality of male terminals respectively mateably engageable with said female terminals; and a plurality of breakout leads respectively connectable between said male terminals and corresponding ones of said female terminals, each of said breakout leads including a length of continuous uniform electrical conductor having opposed ends, an electrically insulating sheath covering only said conductor along substantially the entire length except for a bare uninsulated portion intermediate the ends, a single electrically insulating cover carried by said sheath and movable between first and second positions respectively covering and exposing said bare uninsulated portion, said cover being so dimensioned that in its first position it spans said bare uninsulated portion and engages said sheath at both ends of said bare uninsulated portion, a male lead terminal connected to one of said ends and mateably engageable with one of the female terminals of said socket, and a female lead terminal connected to the other of said ends and mateably engageable with a male terminal of said plug.

9. The combination of claim 8, and further comprising an automotive vehicle onboard computer connected to one of said plug and said socket, and a sensor or controlled device connected to the other of said plug and said socket.

10. The combination of claim 8, and further comprising an electronic device connectable to said plug and said socket.

11. The combination of claim 10, wherein said device includes a probe lead connectable to the bare uninsulated portion of one of said breakout leads.

12. The combination of claim 10, wherein said device includes male and female connectors respectively mateably engageable with female and male terminals of said breakout leads, a first one of said breakout leads connecting said male connector to a first female terminal of said socket, a second one of said breakout leads connecting said female connector to a first male terminal of said plug corresponding to said first female terminal of said socket.

* * * * *